US008493239B2

(12) United States Patent
Dehais et al.

(10) Patent No.: US 8,493,239 B2
(45) Date of Patent: Jul. 23, 2013

(54) METHOD AND A DEVICE FOR DETECTING LACK OF REACTION FROM THE CREW OF AN AIRCRAFT TO AN ALARM RELATED TO A PATH

(75) Inventors: Frédéric Dehais, Toulouse (FR); Laure Christophe, Colomiers (FR); Jean-Michel Merle, Vieille Toulouse (FR); Philippe Pellerin, Auriac sur Vendinelle (FR)

(73) Assignees: Airbus (S.A.S.), Blagnac Cedex (FR); Airbus Operations (S.A.S.), Toulouse Cedex (FR)

( * ) Notice: Subject to any disclaimer, the term of this patent is extended or adjusted under 35 U.S.C. 154(b) by 235 days.

(21) Appl. No.: 12/970,229

(22) Filed: Dec. 16, 2010

(65) Prior Publication Data

US 2011/0148665 A1 Jun. 23, 2011

(30) Foreign Application Priority Data

Dec. 23, 2009 (FR) ..... 09 06296

(51) Int. Cl.
*G08B 21/00* (2006.01)

(52) U.S. Cl.
USPC ..... 340/963; 340/576; 340/945; 701/301; 244/76 R; 244/200

(58) Field of Classification Search
USPC ..... 340/500, 506, 945, 963, 995.1, 995.14, 340/575, 576, 995.11; 701/301, 302, 7–11; 244/118.5, 75.1
See application file for complete search history.

(56) References Cited

U.S. PATENT DOCUMENTS

| | | | | |
|---|---|---|---|---|
| 6,452,511 | B1 * | 9/2002 | Kelly et al. | 340/970 |
| 7,295,134 | B2 * | 11/2007 | Jourdan et al. | 340/963 |
| 2003/0160700 | A1 * | 8/2003 | Gerrity | 340/575 |
| 2005/0073439 | A1 * | 4/2005 | Perricone | 340/945 |
| 2005/0073440 | A1 | 4/2005 | Jourdan et al. | |
| 2006/0167618 | A1 * | 7/2006 | Werback | 701/120 |
| 2011/0037616 | A1 * | 2/2011 | Leutelt et al. | 340/901 |

FOREIGN PATENT DOCUMENTS

FR 2929246 10/2009

OTHER PUBLICATIONS

French Republic Institut National De La Propriete Industrielle, Preliminary Search Report, FR 0906296, Aug. 10, 2010.

* cited by examiner

*Primary Examiner* — George Bugg
*Assistant Examiner* — Edny Labbees
(74) *Attorney, Agent, or Firm* — Wood, Herron & Evans, LLP

(57) ABSTRACT

A method and a device are provided for detecting lack of reaction of the crew of an aircraft to an alarm related to a path. The method includes monitoring the emitting condition of a plurality of alarms related to dangers in the path of the aircraft and monitoring a reaction of a crew during first and second time intervals determined based on how long the crew should take to response to the initial alarm in the first time interval and an auxiliary alarm in the second time interval. The method also includes implementing automatic avoidance operation for coping with the danger if the crew has not reacted to the alarms by the end of the second time interval.

10 Claims, 3 Drawing Sheets

METHOD AND A DEVICE FOR DETECTING LACK OF REACTION FROM THE CREW OF AN AIRCRAFT TO AN ALARM RELATED TO A PATH

TECHNICAL FIELD

This invention relates to a method and a device for detecting lack of reaction from the crew of an aircraft to an alarm regarding a danger related to a path of the aircraft.

BACKGROUND

It is known that modern aircrafts, and specially civilian transport planes, are equipped with different alarm devices which emit alarms upon the occurrence of dangers related to the path followed by the aircraft. In particular, it can be mentioned flight anti-collision systems of the TCAC ("Traffic Collision Avoidance System") type, anti-terrain-collision systems of the TAWS ("Terrain Awareness Warning System") type, systems for detecting disconnection of the auto-pilot, and systems for detecting windshear. The aim of these different devices is to help the crews recovering control of the path of their aircraft, in case an alarm is emitted.

However, many analyses of flight events, pilot training sessions or research works have shown that crews fail to have a systematic suitable reaction to alarms emitted by such usual alarm devices. In particular, it has been observed that sometimes, pilots do not immediately understand the meaning of these alarms and the actions associated therewith, or do not perceive occurrence thereof. This type of behaviour results from a general issue relating to a wrong awareness of the crew about the actual situation of the aircraft and vicinity thereof. This issue can be generated or worsened by the following situations:

- a spatial disorientation which can cause sensory delusions as to how the path and associated alarms are perceived;
- a lack of confidence in on board systems. The crew could choose not to believe an alarm, particularly if they have experienced unexpected alarms or they are too confident in their own interpretation of vicinity;
- the attention of the crew is focused on a particular piloting task or by alarms triggering at the same time as the path related alarm;
- the path related alarm is masked when it is emitted at the same time as other alarms with higher priority; and
- the crew is very much concentrated to achieve a particular aim (for example landing the aircraft) which causes it to ignore the path related alarm.

The object of this invention is to overcome these drawbacks. The invention relates to a method for detecting lack of reaction of the crew of an aircraft to an alarm regarding a danger (or hazardous event) related to a path of the aircraft, which in particular helps the crew to be aware of such alarm, if any.

SUMMARY OF THE INVENTION

To that end, according to the invention, the method is remarkable in that, automatically:

a) the emitting condition of a plurality of usual alarms regarding the dangers related to the path of the aircraft, which are likely to be emitted on the aircraft is monitored;

b) in case one of the alarms is emitted, a first time interval is determined during which the crew should desirably react to the emitted alarm by implementing at least one procedure to cope with the danger this alarm originates from;

c) the reaction of the crew is monitored; and d) if at the end of the first time interval from the emission, the crew has not reacted to the alarm, the following operations are performed:

d1) at least one auxiliary alert signal for signalling the alarm is emitted;

d2) a second time interval is determined during which the crew is required to react to the emitted alarm by implementing the procedure to cope with the danger which caused this alarm; and d3) if at the end of the second time interval the crew has not yet reacted to this alarm, an automatic avoidance operation along an avoidance path to cope with the danger is implemented, the avoidance operation being implemented only if such avoidance path can be calculated.

Thus, thanks to the invention, in case an alarm regarding a danger related to a path of the aircraft is emitted:

- the reaction of the crew is automatically monitored in order to ensure they properly implement the procedure required by the hazardous event the alarm originates from; and
- in case no proper reaction occurs at the end of a (first) time interval, an auxiliary alert signal detailed below is automatically emitted, in order for the crew and specially the pilot of the aircraft, to become aware of such an alarm.

Thus, the crew is properly informed of any alarm regarding the danger related to a path of the aircraft. This danger can correspond, specially to a hazard of collision between the aircraft and another flying machine or the relief of the terrain over which the aircraft is flying, or a hazard of entering a hazardous area (for example an area with very strong turbulence), if the aircraft keeps flying along the followed path.

Preferably, in step d1), several different auxiliary alert signals are emitted simultaneously.

In addition, according to the invention, if the crew does not react to this auxiliary alert signal, an automatic avoidance operation is implemented, using an auto-pilot of the aircraft, if such an operation is possible, particularly if there is sufficient information for calculating the avoidance path to be followed.

Advantageously:

- in step b), the first time interval is determined using information relating to the current state vector of the aircraft and the distance from the current position of the aircraft to the position of the event the alarm originates from; and/or
- in step c), the actions performed by the crew on interface devices of the aircraft are monitored.

Further, advantageously, in step d1):

- it is determined on which interface device is focused the attention of the pilot of the aircraft; and
- at least the auxiliary alert signal is emitted on the interface device thus determined.

Within the scope of the present invention, an auxiliary alert signal may correspond:

- to the initial alarm, the perception of which by the crew is increased (with respect to the usual condition thereof), for example by flashing of a non flashing visual alarm; or
- to a new signal which can be of the same or different type as the alarm.

Besides, if additional usual alarms are emitted simultaneously to the alarm (regarding a danger related to a path of the aircraft), advantageously, in step d1), the relative (sound or light) strength of the latter with respect to the additional alarms (which can be of any type), by decreasing strength thereof.

Further, in a particular embodiment, the following operations are additionally performed:

- the current position of the aircraft is assessed;
- the relief in the vicinity of the current position is determined, in the direction of the flight path of the aircraft; and
- the relief is shown in a flight director horizon, of the ADI ("Attitude Director Indicator") type of a display for viewing primary flight parameters, of the PFD ("Primary Flight Display") type.

Preferably, in this particular embodiment, the relief is shown in three dimensions in the flight director horizon which is, usually, in two dimensions.

This invention also relates to a device for detecting the lack of reaction of a crew of an aircraft to an alarm regarding a danger related to a path of the aircraft.

According to the invention, the device is remarkable in that it comprises:

- means for automatically monitoring the emitting condition of a plurality of alarms regarding dangers related to the path of the aircraft, which are likely to be emitted in the aircraft;
- means for automatically determining, in case one of the alarms is emitted, a first time interval, during which the crew should desirably react to the alarm emitted by implementing at least one procedure to cope with the danger this alarm originates from;
- means for automatically monitoring the reaction of the crew;
- means for automatically emitting at least one auxiliary alert signal, for signalling the alarm, if at the end of the first time interval from which the alarm is emitted, the crew has not reacted to this alarm;
- means for automatically determining a second time interval, during which the crew is required to react to the alarm by implementing the procedure to cope with the danger, the second time interval being determined only if at the end of the first time interval, the crew has not reacted to the alarm; and
- means for automatically implementing, if at the end of the second time interval the crew has not yet reacted to the alarm, an automatic avoidance operation (along an avoidance path) for coping with the danger, the avoidance operation being implemented only if such an avoidance path can be calculated.

In one particular embodiment, the device additionally comprises an alarm device likely to emit in the aircraft alarms regarding dangers related to the path of the aircraft.

This invention also relates to an aircraft, particularly a civilian transport airplane, which is provided with a device as mentioned above.

BRIEF DESCRIPTION OF THE DRAWINGS

The FIGS. of the appended drawing will help better understand how the invention can be implemented. In these figures, identical references refer to similar elements.

DETAILED DESCRIPTION

Figure 1:
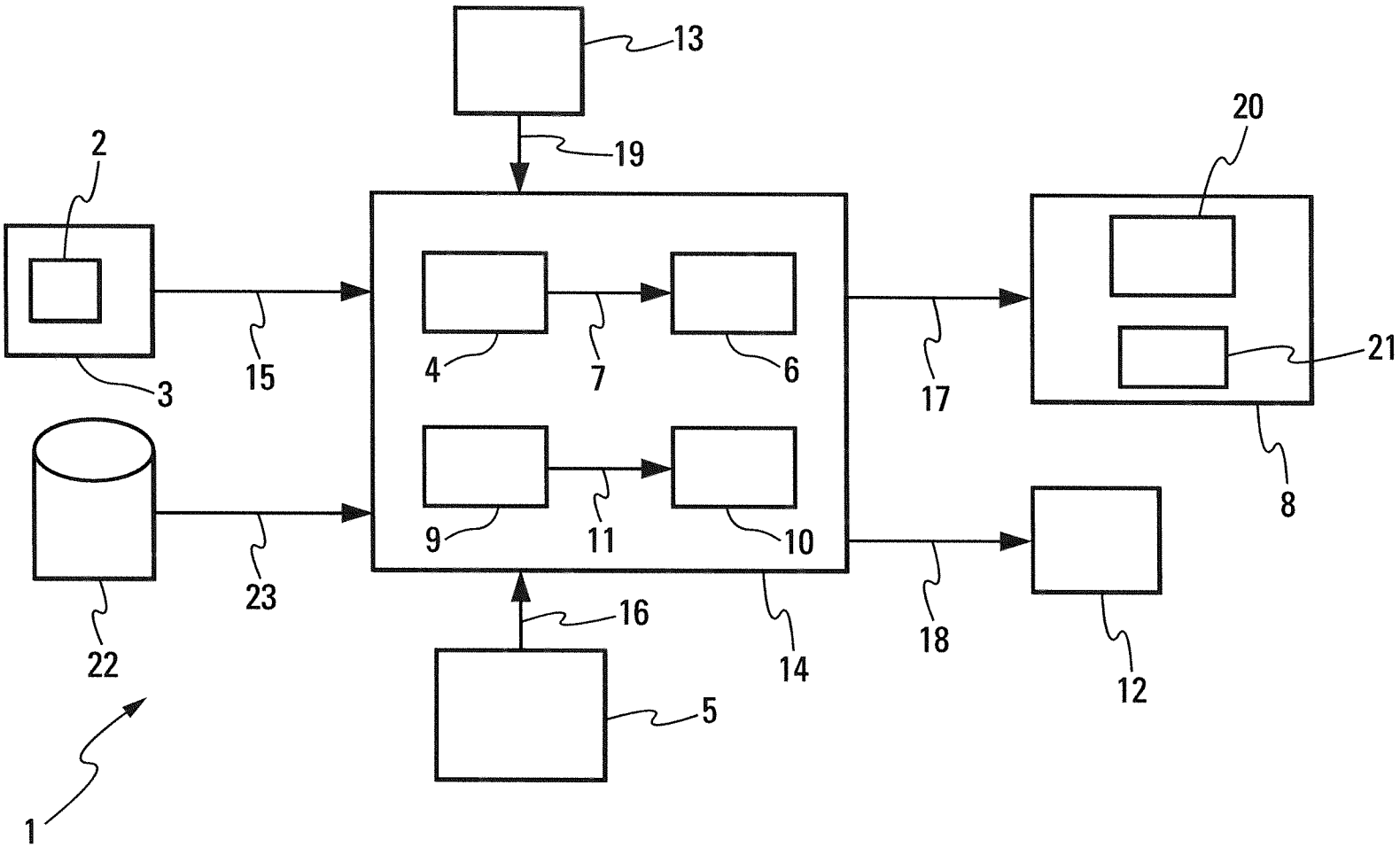
FIG. 1 is a block diagram of a detection device in accordance with the invention.

The device 1 in accordance with the invention and schematically depicted in FIG. 1 is intended to detect lack of reaction of the crew of an aircraft following a particular alarm. Within the scope of this invention, such alarm is generated in the aircraft and regards a danger related to the path followed by the aircraft, particularly a transport plane.

The device 1, which is on board the aircraft (not shown), comprises an alarm monitoring device 2 for automatically monitoring the emitting condition (alarm emitted or not) of a plurality of alarm devices 3, of which only one has been represented in FIG. 1 for the sake of clarity of drawing. These alarm devices 3 are of the usual type and are formed such as to emit alarms in case of a particular danger related to a path of the aircraft. These alarm devices 3 can correspond, particularly, to flight anti-collision systems of the TCAS type ("Traffic Collision Avoidance System"), anti-terrain-collision systems of the TAWS ("Terrain Awareness Warning System") type, systems for detecting the auto-pilot disconnection, and systems for detecting windshear.

Preferably, the alarm monitoring device 2 is integrated into the alarm devices 3 and is likely to emit, in addition to the emitting condition of the alarm devices 3, the procedure(s) to be implemented by the crew upon an alarm emission, which procedures are intended to cope with the danger this alarm originates from.

Such danger (related to the path) can specially correspond to a collision hazard of the aircraft with another flying machine (particularly a plane) or with the relief of the terrain over which the aircraft is flying, or a risk of entering a hazardous area (for example, an area with very strong turbulence), if it keeps on flying along the followed path.

According to the invention, the device 1 additionally comprises:

- a first internal determining device 4 for automatically determining, when the alarm monitoring device 2 detects the emission of an alarm by at least one of the alarm devices 3, a first time interval T1, during which the crew should react desirably (but not necessarily required) to the emitted alarm, by implementing at least one procedure (specially received from the alarm monitoring device 2 which allows it to cope with the danger this alarm originates from, for example an avoidance operation in order to avoid another flying machine or relief;
- a crew monitoring device 5 automatically monitoring the reaction of the crew following the emission of an alarm. This crew monitoring device 5 is, particularly able to detect all the actions carried out by the crew on interface devices and specially on piloting devices, particularly a usual control stick, which is provided in the cockpit of the aircraft. This crew monitoring device 5 can comprise devices described in the French patent application FR-2, 929,246, for detecting lack of manual control of the aircraft and an auto-pilot disconnection; and
- an instruction generation device 6 which is connected through a link 7 to a first internal determining device 4 and which are formed such as to automatically generate instructions for emitting an auxiliary alert signal which will be displayed to the crew using the signalling device 8.

According to the invention, an auxiliary alert signal enables the emission of an alarm to be signalled and highlighted, and this auxiliary alert signal is only emitted if, at the end of said time interval T1 from the beginning of the alarm, the crew has not reacted to this alarm.

Within the scope of this invention, an auxiliary alert signal may correspond:

to the initial alarm, of which the perception by the crew is strengthened (with respect to the usual condition thereof), for example by flashing of a non flashing usual alarm; or to a new alert signal, which can be of the same or different type as the initial alarm.

In order to do so, the signalling device 8 can comprise:

a visual indicator device 20 for displaying a visual signal, particularly on a viewing screen 27; and/or audible indicator device 21 for emitting an audible alert signal.

Preferably, instruction generation device 6 and signaling device 8 emit simultaneously or successively several different auxiliary alert signals.

The device 1 additionally comprises:

a second internal determining device 9 for automatically determining a second time interval T2, during which the crew is required (for safety reasons) to react to the alarm by implementing the procedure to cope with the danger. This second time interval T2 is only determined if at the end of the time interval T1 after emitting the alarm, the crew has not reacted to this alarm; and an avoidance path generation device 10 which is connected through a link 11 to the second internal determining device 9 and which generate set points for implementing an automatically avoidance operation which is performed through an auto-pilot device 12 of the usual type. This automatically avoidance operation is implemented if, at the end of time interval T2 (which begins at the end of time interval T1), the crew has not yet reacted to the alarm. This avoidance operation is, for the aircraft, to fly automatically following an avoidance path in order to cope with the danger the alarm originates from. However, this avoidance operation is only implemented if such an avoidance path can be calculated, that is if the required information for automatically calculating (in a usual way) such an avoidance path is available for the device 1. The device 1 can comprise usual devices (not shown) for determining an avoidance path.

Therefore, in case an alarm regarding a danger related to a path of the aircraft is emitted, the device 1 in accordance with the invention:

automatically monitors the reaction of the crew (using the crew monitoring device 5) in order to ensure it properly implements the required procedure for avoiding the occurrence of the hazardous event which caused the alarm; and in case the proper reaction is missing at the end of time interval T1, automatically emits an auxiliary alert signal in order for the crew, and particularly the pilot of the aircraft, to become aware of this alarm.

Thus, the crew is well-informed of any alarms regarding to a danger related to a path of the aircraft. Such danger can particularly correspond to a collision hazard between the aircraft and another flying machine or the relief of the terrain over which the aircraft is flying, if it keeps on flying along the followed path.

In addition, if the crew does not react to this auxiliary alert signal, the device 1 implements an automatic avoidance operation, using the auto-pilot 12, if such an operation is possible, particularly if there is sufficient information for calculating the avoidance path to be followed.

The device 1 additionally comprises movement information sources 13 which include usual inertial information sources and/or a satellite positioning system, for example of the GPS type, and which are able to provide information relating to the current state vector of the aircraft, that is particularly the current position, current vertical speed and current altitude thereof.

In one particular embodiment, the first internal determining device 4 determines the time interval T1 using the information relative to the current state vector of the aircraft and the distance from the current position of the aircraft to the position of the element (terrain, flying machine,) the alarm originates from.

Further, in a preferred embodiment, the first internal determining device 4, the instruction generation device 6, the second internal determining device 9 and the avoidance path generation device 10 are part of a calculation unit 14 which is connected through links 15, 16, 17, 18 and 19, to alarm devices 3, the crew monitoring device 5, the signaling device 8, the auto pilot device 12 and the movement information sources 13, respectively.

Besides, if additional usual alarms are emitted at the same time as an alarm (regarding a danger related to a path of the aircraft) in the cockpit of the aircraft, the device 1 can increase the (sound or light) strength of the latter with respect to the additional alarms (which can be of any type), such that it can be perceived by the crew.

In one particular embodiment:

a crew monitoring device 5 determines, in a usual way, on which interface device, for example a viewing screen 27, is focused the attention of the pilot of the aircraft; and the instruction generation device 6 and signaling device 8 emit said auxiliary alert signal at least on the interface device thus determined.

Further, in one particular embodiment, the device 1 additionally performs the following operations:

it assesses, using movement information sources 13, the current position of the aircraft;

it determines the relief in the vicinity of the current position, the relief being for example transmitted by a data base 22 of the relief via a link 23 to the calculation unit 14; and it shows, using signaling device 8, the relief in a flight director horizon 26, of the ADI ("Attitude Director Indicator") type, of a parameter viewing screen 27 for viewing the primary flight parameters, of the PFD ("Primary Flight Display") type, as detailed below.

The parameter viewing screen 27 can comprise, in a usual way, in addition to the flight director horizon 26, as shown in FIGS. 2 to 5, particularly usual scales 28, 29 and 30 of speed, altitude and heading.

In one particular embodiment, the device 1 is formed in order to show the relief in three dimensions in the flight director horizon 26 which is in two dimensions.

This invention is described hereinafter by different examples, referring to FIGS. 2 to 5.

Figure 2:
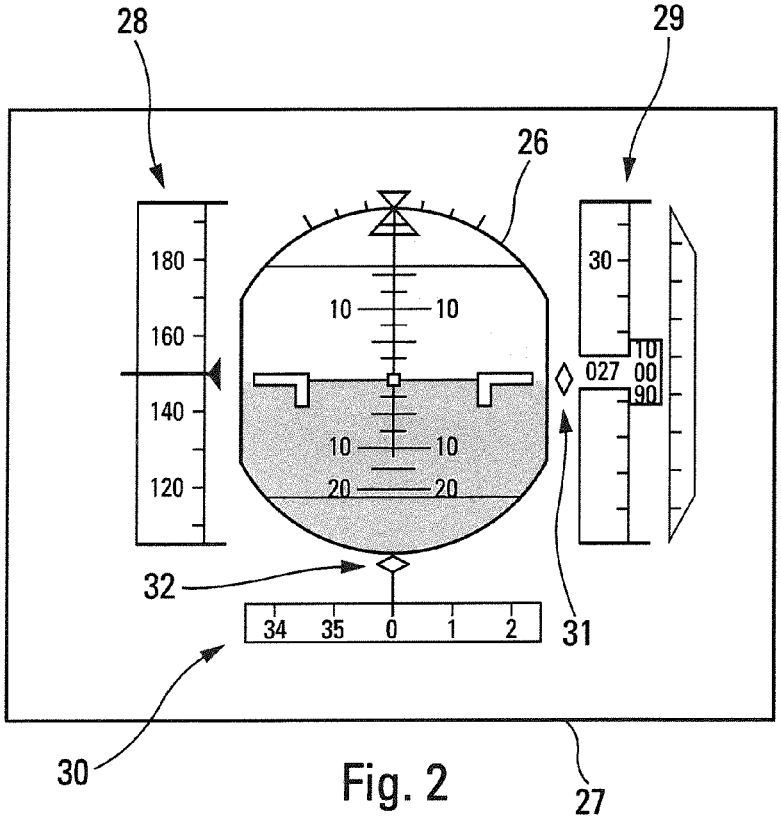
FIGS. 2 to 5 show particular displays of auxiliary signs in accordance with the invention, which are shown on a screen for viewing primary flight parameters.

In a first example, the aircraft is in the landing phase, with no visibility, and the alarm monitoring device 2 detects an alarm which indicates windshear. The crew monitoring device 5 determines that, in this flight phase, the pilots are particularly focused on their primary flight parameter viewing screen 27, such as the one which is depicted in FIG. 2, and particularly on the usual indication elements 31 and 32 related to the instrument landing of the ILS ("Instrument Landing System") type. If, after time interval T1, the pilots have not reacted to the alarm related to windshear, the device 1 will emit (using signaling device 8) different auxiliary alert signals, that is:

a short lighting, for example red, of the background of both parameter viewing screens 27 which are generally available in the cockpit of an aircraft; and the successive display of messages indicating windshear and requesting a go around, instead of the display of indication elements 31 and 32, during time interval T2.

In a second example, the aircraft is still in landing phase with no visibility, and the alarm monitoring device 2 identifies a disconnection of the auto-pilot system, for example the auto-pilot device 12. The alarm monitoring device 2 also identifies that the audible alarm which is emitted upon such disconnection has been masked by the simultaneous onset of an audible alarm higher priority. The crew monitoring device 5 analyses at the end of time interval T1, that the auto-pilot system is still disconnected and the pilots are not acting on the control stick. The crew monitoring device 5 also determines that, during this flight phase, the pilots are particularly focused on the primary flight parameter viewing screen 27, as depicted in FIG. 2, and particularly on the usual indication elements 31 and 32 relating to the instrument landing of the ILS type. Thus, at the end of time interval T1, the device 1 generates the following auxiliary alert signals:

- inhibition of the alarm with higher level which masked the auto-pilot system disconnection alarm;
- a short light, for example a red one of the background, of both primary flight parameter viewing screens 27;
- and then the successive display of messages ("Fly your A/F") in order to prompt pilots to recover control of the aircraft and an alert ("AP OFF") in order to report the auto-pilot system disconnection.

Figure 3:
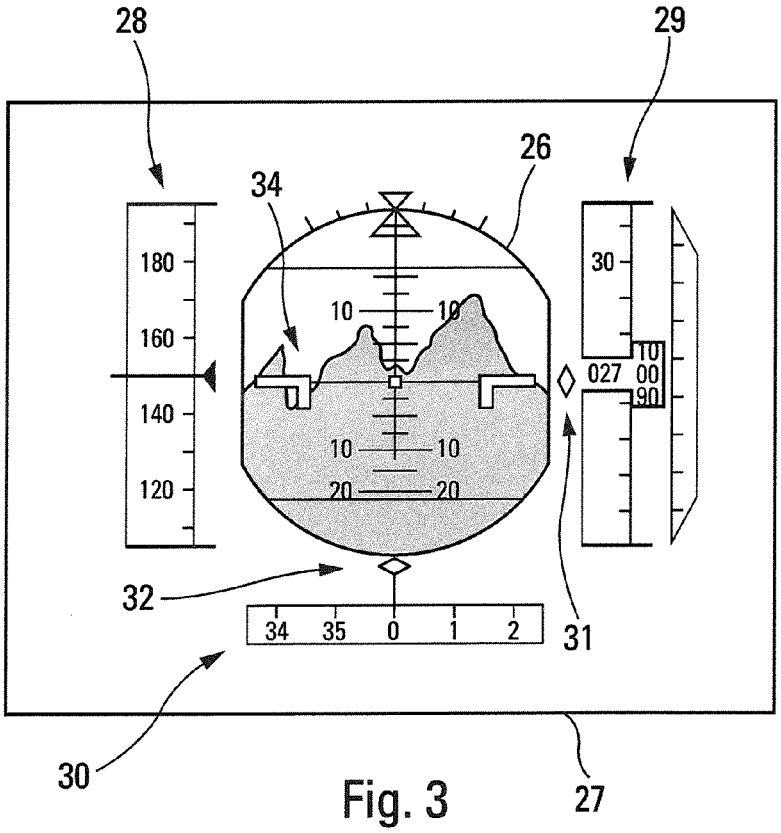

Further, if in this example the crew has not reacted at the end of time interval T2, the device 1 will automatically trigger the auto-pilot system again, and signaling device 8 will display the appropriate usual information. Further, in a third example, the aircraft is in the landing phase, with no visibility, and the alarm monitoring device 2 detects an alarm which indicates that the ground is too close due to, for example, mountainous ground. The crew monitoring device 5 determines that, during this flight phase, the pilots are particularly focused on the primary flight parameter viewing screen 27, and especially on the usual indication elements 31 and 32 relating to an instrument landing. If, after time interval T1, the pilots have not reacted to this alarm, the device 1 will emit different auxiliary alert signals, that is:

- a short light, for example a red one of the background of both parameter viewing screens 27 which are generally available in the cockpit;
- the display of a message instructing a pull up, instead of a display of indication elements 31 and 32, during time interval T2; and
- a strike over display on the flight director horizon 26 of the primary flight parameter viewing screen 27, as depicted in FIG. 3, of a stylized image 34 of the mountainous ground, in order to transmit a strong emotional message.

The visual representation 34 of the relief which therefore directly appears displayed in the primary flight interfaces:

- provides simple and relevant perceptive indices in order to assist the crew in adjusting the path in order to avoid the relief; and
- transmit a strong emotional content in order to prompt the crew to implement a relief avoidance operation.

Figure 4:
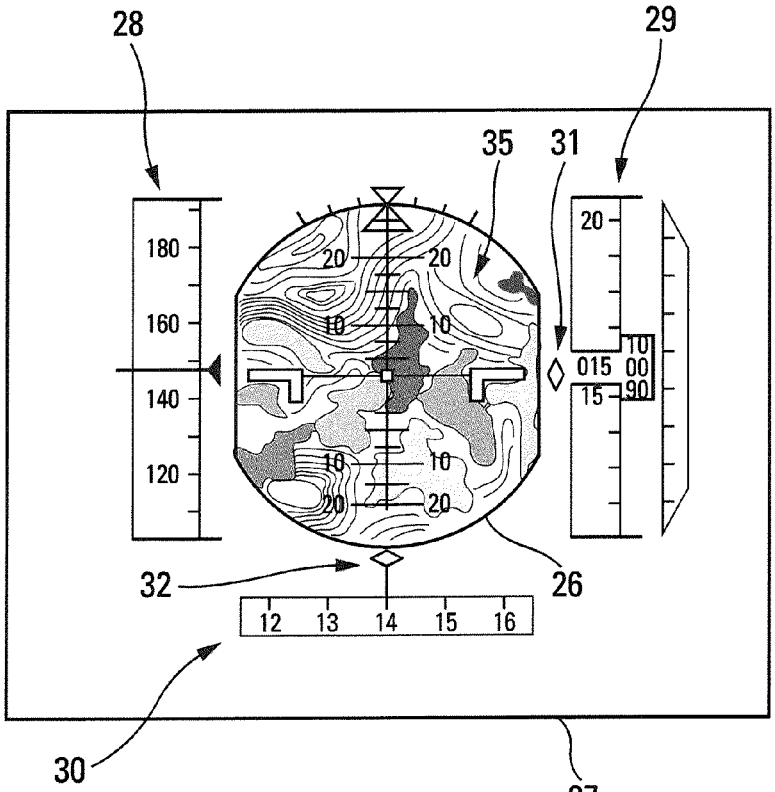

Further, in a fourth example, the aircraft is in the landing phase with no visibility, and the alarm monitoring device 2 also detects an alarm which indicates that the ground is too close due to the presence of a mountainous ground. The crew monitoring device 5 determines that, in this flight phase, the pilots are particularly focused on the primary flight parameter viewing screen 27, and particularly on the usual indication elements 31 and 32 relating to an instrument landing. If, after time interval T1, the pilots have not reacted to this alarm, the device 1 will emit different auxiliary alert signals, that is:

- a short (red) lighting of the background of both parameter viewing screens 27 which are available in the cockpit;
- the display of a message instructing a pull up, instead of a display of indication elements 31 and 32, during time interval T2; and
- the strike over display on the flight director horizon 26 of the parameter viewing screen 27, of information about the relief 35 in two dimensions, as depicted in FIG. 4, which information is generally available on a usual navigation display device of the ND ("Navigation Display") type.

Figure 5:
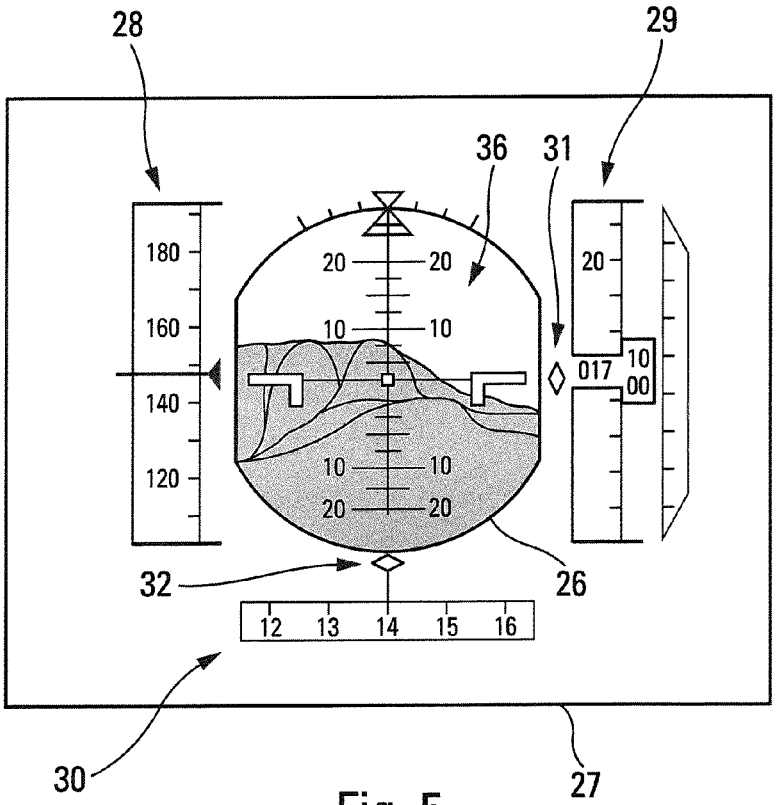

Besides, in a fifth example which is similar to the third and fourth preceding examples, the device 1 can display, in the flight director horizon 26 of the screen 27, a visual representation 36 of the relief in three dimensions, as depicted in FIG. 5.

In order to generate this visual representation 36, the device 1 implements the following operations:

- it assesses, using movement information sources 13, the current position of the aircraft;
- it determines the virtual relief to be displayed, by matching the assessed current position of the aircraft with the data base 22 (received by the calculation unit 14 via link 23), and
- it scales the virtual relief in order to provide a dynamic display thereof, using signaling device 8, in the flight director horizon 26 such that it appears meeting a consistent compliance with the aircraft attitude and tilt information (received, for example, from movement information sources 13).

An exemplary application of this latter alternative is the case where an alarm of the pull up type occurs simultaneously with an overspeed alarm, for example as a result of exceeding the allowed speed in an aerodynamic configuration with flaps out. In this case, the device 1 emits auxiliary alert signals corresponding to the following actions:

- displaying the relief 36 in three dimensions in the flight director horizon 26;
- inhibiting the overspeed-related audible alarms; and
- masking, partly, an overspeed alarm usually symbolised by a red ribbon (not shown) on screen 27, and this, as long as the pull up type alarm is enabled.

The invention claimed is:

1. A device for detecting lack of reaction of a crew of an aircraft to an alarm regarding the danger related to a path of the aircraft, the device comprising:

- an alarm monitoring device for automatically monitoring the emitting condition of a plurality of alarms regarding dangers related to the path of the aircraft;
- a first internal determining device for automatically determining, in case one of the alarms is emitted, a first time interval, for the crew to react to the alarm emitted by implementing at least one procedure to cope with the danger causing the emitted alarm;
- a crew monitoring device for automatically monitoring the reaction of the crew without implementing an automatic avoidance operation during the first time interval;
- an instruction generation device and a signalling device automatically emitting an auxiliary alert signal, if at the end of the first time interval from the emitted alarm, the crew has not reacted to the emitted alarm;
- a second internal determining device for automatically determining a second time interval, for the crew to react to the alarm by implementing a procedure for coping with the danger, the second time interval being determined only if at the end of the first time interval, the crew has not reacted to the alarm; and an avoidance path generation device and an auto pilot device for automatically implementing, if at the end of the second time interval the crew has not yet reacted to the alarm, an automatic avoidance operation along an avoidance path for coping with the danger, the avoidance operation being implemented only if such an avoidance path can be calculated.

2. The device according to claim 1, further comprising:

an alarm device configured to emit in the aircraft alarms regarding dangers related to the path of the aircraft.

3. A method for detecting lack of reaction of a crew of an aircraft to an alarm regarding a danger related to a path of the aircraft, the method comprising the following steps carried out automatically:

(a) monitoring the emitting condition of a plurality of alarms regarding the dangers related to the path of the aircraft;

(b) in case one of the alarms is emitted, determining a first time interval for the crew to react to the emitted alarm by implementing at least one procedure for coping with the danger this alarm originates from;

(c) monitoring the reaction of the crew during the first time interval without implementing an automatic avoidance operation during the first time interval; and (d) only if at the end of the first time interval from the emission, the crew has not reacted to the alarm, performing the following operations:

(d1) emitting at least one auxiliary alert signal;

(d2) determining a second time interval for the crew to react to the emitted alarm by implementing a procedure for avoiding the danger the emitted alarm originates from; and (d3) if at the end of the second time interval the crew has not yet reacted to the emitted alarm, implementing an automatic avoidance operation along an avoidance path for coping with the danger, the avoidance operation being implemented only if such avoidance path can be calculated.

4. The method according to claim 3, wherein in step (b), the first time interval is determined using information regarding the current state vector of the aircraft and the distance from the current position of the aircraft to the position of the event the alarm originates from.

5. The method according to claim 3, wherein in step (c), the actions performed by the crew are monitored on interface devices of the aircraft.

6. The method according to claim 3, wherein the aircraft includes a plurality of parameter viewing screens selectively used by the pilot and wherein step (d1) further includes:

determining the parameter viewing screen where the attention of the pilot of the aircraft is currently focused; and emitting the auxiliary alert signal at least on the parameter viewing screen thus determined.

7. The method according to claim 3, wherein in step (d1), if additional alarms are emitted simultaneously with the emitted alarm regarding a danger related to a path of the aircraft, the strength of the emitted alarm regarding a danger related to a path of the aircraft is increased with respect to the additional alarms.

8. The method according to claim 3, wherein in step (d1), several different auxiliary alert signals are emitted simultaneously.

9. The method according to claim 3, further comprising:

assessing the current position of the aircraft;

determining the relief in the vicinity of the current position; and showing the relief in a flight director horizon of a parameter viewing screen for viewing the primary flight parameters.

10. The method according to claim 9, wherein the relief is shown in three dimensions in the flight director horizon which is in two dimensions.

* * * * *